United States Patent [19]

Kawamo et al.

[11] Patent Number: 4,473,416

[45] Date of Patent: Sep. 25, 1984

[54] PROCESS FOR PRODUCING ALUMINUM-BEARING GRAIN-ORIENTED SILICON STEEL STRIP

[75] Inventors: Yakichiro Kawamo, Ashiyamachi; Jirou Harase, Munakatamachi, both of Japan

[73] Assignee: Nippon Steel Corporation, Tokyo, Japan

[21] Appl. No.: 396,062

[22] Filed: Jul. 7, 1982

[51] Int. Cl.[3] ..... H01F 1/04

[52] U.S. Cl. ..... 148/111; 148/113

[58] Field of Search ..... 148/111, 112, 113

[56] References Cited

U.S. PATENT DOCUMENTS

| | | | |
|---|---|---|---|
| 3,940,299 | 2/1976 | Goto et al. | 148/111 |
| 4,123,299 | 10/1978 | Fiedler et al. | 148/111 |
| 4,251,295 | 2/1981 | Foster et al. | 148/120 |

FOREIGN PATENT DOCUMENTS

| | | | |
|---|---|---|---|
| 55-34633 | 3/1980 | Japan | 148/111 |

*Primary Examiner*—John P. Sheehan

*Attorney, Agent, or Firm*—Wenderoth, Lind & Ponack

[57] ABSTRACT

A process for producing an aluminum-bearing grain-oriented silicon steel strip from a silicon steel slab containing up to 0.02% carbon, 0.01 to 0.1% aluminum, 2.7 to 4.0% silicon, and 0.002 to 0.02% nitrogen, the balance being iron and unavoidable impurities, said slab optionally containing at least one of 0.01 to 0.5% antimony and 0.01 to 1.0% copper, said process comprising: recrystallization hot rolling said slab, said rolling being commenced when said slab has a temperature up to 1,250° C., and effected at a total reduction rate of at least 80% with a plurality of passes, including at least one pass having a reduction rate of at least 35%, before said steel has a temperature of 900° C.; strain accumulation finish hot rolling said steel at a total reduction rate of at least 40% and at a steel temperature up to 900° C.; annealing said hot rolled steel continuously at a temperature of 700° C. to 950° C.; cold rolling said steel; annealing said cold rolled steel continuously at a temperature of 700° C. to 900° C. for primary recrystallization; and finish annealing said steel, an atmosphere gas containing at least 30% of nitrogen being introduced during the heating step of said finish annealing when a temperature of 800° C. to 1,000° C. prevails.

8 Claims, No Drawings

PROCESS FOR PRODUCING ALUMINUM-BEARING GRAIN-ORIENTED SILICON STEEL STRIP

BACKGROUND OF THE INVENTION

1. Field of the Invention

This invention relates to an improvement in the process for producing an aluminum-bearing grain-oriented silicon steel strip.

2. Description of the Prior Art

When a grain-oriented electrical steel strip is manufactured from a continuously cast steel slab by a process involving hot rolling followed by a single cold rolling operation, it has conventionally been necessary to use as the starting material a slab containing about 0.04% C and about 3% Si, namely a component system wherein $\alpha$ to $\gamma$ phase transformation occurs at a high temperature, and further containing an inhibitor such as Mn, S, Al, N etc. The slab is heated to a temperature of 1,300° C. or higher so as to dissolve the inhibitor and is then hot rolled, whereafter the hot rolled sheet is annealed, cold rolled, decarburization annealed, coated with an annealing separator, recrystallized, and subjected to batch annealing for the purpose of desulfurization and denitrification. This method is characterized by the fact that it employs as the starting material a slab having a component system wherein $\alpha$ to $\gamma$ phase transformation occurs at a high temperature, it being possible at the time of secondary recrystallization to obtain the $\alpha$ single phase system which is essential for secondary recrystallization by decarburization annealing. Another characteristic of the method is that the $\gamma$ to $\alpha$ transformation plays an important role in the formation of a finely divided and distributed inhibitor phase, namely AlN, and in the formation of a finegrained matrix.

Although the conventional method provides an electrical steel strip with excellent magnetic properties in the rolling direction, it nevertheless suffers from the following defects.

(1) Since it uses as the raw material a slab having an $\alpha$ to $\gamma$ transformation temperature lower than the secondary recrystallization temperature, conversion to $\alpha$ single phase is necessary prior to batch annealing.

(2) In an Fe—3% Si—0.04% C system, if the amount of Si is increased there will result a decrease in the amount of $\gamma$ phase. If the amount of C is then increased to obtain the required amount of $\gamma$ phase, the increases in the Si and C contents combine to cause a degradation in the cold rolling properties. Thus it is difficult to realize a reduction in iron loss by increasing the Si content.

(3) As the slab used as the starting material contains C, N and S, all of which tend to degrade the electrical properties of the steel, it is necessary to carry out purification annealing.

(4) In order to obtain a finely divided and distributed inhibitor phase it is necessary to carry out high temperature heating of the slab and high temperature annealing of the hot rolled sheet.

The inventors carried out experiments in order to find ways to overcome these defects of the prior art as completely as possible. First they prepared slabs by adding Si and Al to pure iron while holding the content of other elements to the lowest level possible, and then subjected the so-prepared slabs to processing under various conditions. Of 500 test pieces used in this experiment only one exhibited secondary recrystallization after a single cold rolling. The experiment was further continued using only a single cold rolling step. As a result it was found that five test pieces, one of which used as its starting material a hot rolled strip containing 0.002% C, 2.65% Si, 0.01% Mn, 0.008% S, 0.020% Al and 0.008% N, had coarse grains with diameters of 40–80 mm. From the shape of the coarse grains it was judged that their formation even in a hot rolled strip having low Mn and S contents was the result of a heat flow in the direction of the sheet surface resembling that in the method of producing single crystals or in the zone melting method.

In succeeding experiments it was found that coarse grains could be produced in the (011) [100] direction using as the starting material a hot rolled strip comprising 0.002% C, 3.00% Si, 0.03% Mn, 0.004% S and 0.02% Al, namely a hot rolled strip with a pure composition. Thus the next subject to be studied in order to realize an industrially practical method was that of producing coarse grains in the (011) [100] direction of converter steel containing impurities. For this purpose, a continuously cast slab of converter steel was remelted and then hot rolled to obtain a hot rolled strip. When this hot rolled strip was subjected to a single cold rolling, there was obtained a hot rolled sheet containing 0.05% Al and having coarse grains in the (011) [100] direction.

However, even in the test pieces which exhibited coarse grains in the (011) [100] direction, when these pieces were annealed in stacked condition, it was found that fine grains occurred at the gaps between the strips, namely at the portions constituting paths for the annealing gas and at the edges of the sheets. Thus it was necessary to make an investigation to determine the conditions under which coarse grains could be obtained in the (011) [100] direction at the portions in contact with the annealing gas, namely at the portions where there was no flow of heat in the direction of the strip surface.

In the case of annealing a stack of as-cold-rolled strips the curl of the strips causes various problems such as making it difficult to stack the sheets in intimate contact with each other, degrading the coating property of the annealing separator, causing the coarse grains in the (011) [100] directions to become too large. In order to alleviate these problems, the cold rolled sheets were subjected to primary recrystallization annealing involving rapid heating and were thereafter coated with the annealing separator and stacked. The primary recrystallization annealing increased the plasticity of the sheets and made them easier to stack. This knowledge has been disclosed in Japanese Patent Public Disclosures Nos. 55-154525 and 56-13433.

In this case, coarse grains were formed in the batch annealing carried out after the primary recrystallization annealing. Therefore, the coarse grains are referred to as secondary recrystallization grains.

SUMMARY OF THE INVENTION

It is an object of this invention to eliminate the aforesaid drawbacks of the prior art, and provide an economical process for the production of an aluminum-bearing grain-oriented silicon steel strip which permits hot rolling at a low temperature, and does not require decarburization after hot rolling.

Another object of this invention is to provide such a process of improved efficiency by using as the starting material a slab wherein $\alpha$ to $\gamma$ phase transformation does not occur, and carrying out secondary recrystallization at a stage of the production process following hot rolling, more particularly a process which eliminates the inefficiency of the conventional process of employing $\gamma$ transformation to produce an inhibitor.

Still another object of this invention is to provide such a process wherein a slab having a low carbon content is used as the starting material in order to eliminate or reduce the need for solid-phase decarburization.

Still another object of this invention is to provide such a process whereby a strip with good cold rolling properties can be obtained even when the Si content is increased.

Still another object of this invention is to provide such a process wherein no high-temperature heating of the slab is required.

Still another object of the present invention is to provide such a process wherein the need for purification annealing is reduced or eliminated.

The inventors have studied the conditions which enable secondary recrystallization to take place effectively for improved crystal orientation in the production of an aluminum-bearing grain-oriented silicon steel strip. As a result, they have found it necessary that (i) a large number of (110) [100] grains of improved orientation for secondary recrystallization be present in the steel strip at a depth of about 30 to 100 microns below its surface, (ii) that the crystal grains in the matrix be equal in size to, or smaller than the Goss grains to enable only the Goss grains to grow during the step of secondary recrystallization, and (iii) that an inhibitor be appropriately distributed to inhibit coarsening of the grains in the matrix to thereby enable only the Goss grains to grow. They have finally arrived at a process which satisfies these three requirements without heating the slab to a high temperature, annealing the hot rolled strip at a high temperature, or decarburization during the step of primary recrystallization annealing.

DETAILED DESCRIPTION OF THE INVENTION

In order to ensure the presence of Goss grains in the surface layer of the strip, it has been found possible to obtain a higher degree of recrystallization in the surface layer than in the center of the strip, and thereby a higher density of Goss grains, if hot rolling is started at a temperature not exceeding 1,250° C., preferably between 1,050° C. and 1,150° C., and is conducted at a total reduction rate of at least 80% with a plurality of passes, including at least one pass at a reduction rate of at least 35%, with a steel temperature of at least 900° C., preferably at least 1,000° C. The Goss grains undergo recrystallization again after cold rolling. In order to raise the density of the Goss grains, it is advisable to employ a high reduction rate of at least 80% for cold rolling, and a high heating rate of at least 10° C. per second from ordinary room temperature to 800° C. for primary recrystallization annealing, as is the case in the production of grain-oriented silicon steel having a high carbon content. According to this invention, it is also necessary to employ as high a heating rate as possible for annealing the hot rolled strip, and therefore, to anneal it continuously.

In order to prevent coarsening of the crystal grains in the matrix, it is necessary to ensure that the crystal grains of the steel to be hot rolled have as small a diameter as possible. It is preferred that they have an average diameter not exceeding 10 mm. It is, therefore, necessary to employ a temperature not exceeding 1,250° C. for heating 0-the slab. It is also effective to employ DKS for casting, low temperature casting, inline reduction or breakdown, or a continuous casting and direct reduction process. After the grain size of the steel has, thus, been controlled, hot rolling is started at a temperature not exceeding 1,250° C., preferably between 1,050° C. and 1,150° C., and is conducted until a total reduction rate of at least 80% is obtained, including at least one pass at a reduction rate of at least 35%, before the steel temperature drops below 900° C., and preferably before it drops below 1,000° C., whereby recrystallization is promoted to finely divide the crystal grains.

The process of this invention is, however, intended to produce a steel composed solely of the $\alpha$ phase, having a very low carbon content, and containing only a very small quantity of impurities. The crystal grains of a steel of this type are difficult to divide finely in the center of the strip remote from its surface even if recrystallization is promoted during hot rolling. It has, however, been found possible to realize fine division of crystal grains in the center of the strip by continuing rolling at a temperature not exceeding 900° C., preferably not exceeding 800° C., at a total reduction rate of at least 40% preferably at least 80%, to cause strain to accumulate in the center of the strip, and utilizing the accumulated strain as the energy for annealing the strip at a temperature of 700° C. to 900° C. for a short time. If the crystal grains can be finely divided before cold rolling, it is also possible to obtain finely divided crystal grains in the matrix after cold rolling and recrystallization.

For the primary recrystallization annealing of the cold rolled strip, it is advisable to employ a temperature not higher than 900° C., and not lower than about 700° C. to enable recrystallization without involving coarsening of the crystal grains in the matrix, and as high a heating rate as possible to obtain a higher density of Goss grains. It is advisable to finish the annealing quickly to prevent coarsening of the crystal grains.

It is effective to use a combination of upper and lower rolls having different diameters or different rotating speeds for recrystallization hot rolling for obtaining the Goss grains, and for strain accumulation hot rolling for dividing the crystal grains finely. For strain accumulation rolling, however, it is necessary to lower the strip temperature rapidly at 900° C. or below, or preferably 800° C. or below during the latter part of finish hot rolling. It is, therefore, advisable to provide a relatively large distance between the roll stands in the latter part of a finish hot rolling mill, and install therebetween a device for the forced cooling of the strip as if it were cooled on a runout table. There is no particular limitation to the rate at which the strip is cooled after it has been finish hot rolled, or the temperature at which it is coiled. It is, however, desirable to cool it rapidly and coil it at a low temperature in order to prevent the accumulated strain from being released.

According to this invention, the strain accumulation hot rolling of the strip is carried out during the step of finish hot rolling. If the strip cannot be finished rolled at a satisfactorily low temperature, it is acceptable to finish roll the strip in a customary way, reheat it to a temperature of 650° C. to 800° C., and subject it to offline rolling at a reduction rate of at least 40%, though it is not recommendable from the standpoint of economy.

The step of strain accumulation hot rolling in the process of this invention is also effective for preventing the embrittlement of the hot rolled strip. If steel containing more than 3% of silicon is hot rolled into a strip by a conventional process, the strip as rolled is so brittle as to crack or break easily when it is pickled or cold rolled. This problem can be avoided by the strain accumulation hot rolling of the strip at a low temperature in accordance with this invention, since it provides a product having a higher degree of crystal dislocation as if its crystal grains were finely divided. If the hot rolled strip is annealed at a temperature of 700° C. to 950° C. for a short time, its embrittlement can be avoided, since its crystal grains are finely divided by recrystallization.

In the conventional manufacture of a grain-oriented silicon steel strip employing a slab heating temperature as high as about 1,400° C., hardly any strain is accumulated in the hot rolled strip, since hot rolling is finished at a temperature as high as about 1,000° C. If steel contains more than 3% of silicon, the strip as hot rolled is brittle, and even if it is annealed at a temperature as high as 1,100° C., it remains brittle despite its relatively higher carbon content than that of the starting material in this invention, since the lack of strain accumulation prevents the crystal grains from being finely divided.

It is also important to distribute an inhibitor to inhibit the growth of crystal grains in the matrix to thereby cause only the Goss grains to grow by secondary recrystallization. In the conventional production of an aluminum-bearing grain-oriented silicon steel strip, AlN forms a solid solution completely when the slab is heated to about 1,400° C., the slab is hot rolled immediately thereafter so that no AlN may be precipitated during hot rolling, and the inhibitor is finely distributed by virtue of a difference in solubility as a result of the $\gamma$ to $\alpha$ phase transformation when the hot rolled strip annealed at a temperature of 1,100° C. is cooled. According to the process of this invention, employing a slab heating temperature of 1,100° C. to 1,200° C., AlN not completely, but only partly forms a solid solution if the slab contains the same quantities of Al and N as in the prior art, and this part of AlN forming a solid solution is finely precipitated during the step of hot rolling and later functions as an inhibitor. If it is required to obtain a stronger inhibitor effect, it is very effective to add 0.01 to 0.5% of Sb or 0.01 to 1% of Cu or both, each of which is an element of the grain boundary segregation type not affected by the slab heating temperature. It is equally effective to add one or more of other inhibitor elements, such as Ni, B, Bi, Ti, Zr, Nb, V and Zn.

In order to distribute AlN finely, it is first necessary to hot roll the slab as quickly as possible within 10 minutes before the steel temperature drops to 950° C., in order to minimize precipitation of large AlN grains in a relatively high temperature range. It is, then, important to anneal the hot rolled strip for a short time at a temperature in the vicinity of about 850° C. at which AlN is finely precipitated. The conventional production of grain-oriented silicon steel requires annealing at a high temperature of 1,100° C., since the $\gamma$ to $\alpha$ phase transformation is utilized for fine distribution of AlN. According to the process of this invention employing silicon steel having a very low carbon content, and composed solely of the $\alpha$ phase, however, AlN can be directly precipitated from the $\alpha$ phase. It is necessary to employ an annealing temperature not exceeding 950° C., since a higher temperature undesirably causes coarsening of AlN grains in the $\alpha$ phase. Insofar as the annealing of the hot rolled strip is carried out continuously, however, it is desirable to employ an annealing temperature not lower than 800° C., since a lower temperature necessitates a longer heating time, though it enables fine distribution of the inhibitor. Thus, the metallurgical significance of the annealing of the hot rolled strip according to the process of this invention resides, in the first place, in the fine division of crystal grains in the central layer of the strip by recrystallization by rapid heating. Although a higher heating temperature and a higher heating rate result advantageously in an increase in the Goss grains, an annealing temperature not exceeding 950° C. is employed to avoid coarsening of the crystal grains and precipitated AlN grains. In the second place, the annealing of hot rolled strip is conducted to promote precipitation of fine AlN grains. A temperature of about 850° C. is most effective for that purpose, and the length of the time for which the hot rolled strip is kept at that temperature depends on the precipitation of AlN prior to annealing. Thus, the first half of the annealing step is intended for the formation of Goss grains, and the recrystallization of steel in the central layer of the strip, and the second half for the promotion of precipitation of fine AlN grains. The composition of the steel, and the conditions under which it has been hot rolled may be taken into consideration in the selection of the optimum conditions under which the hot rolled strip may be annealed. It must be kept in mind that the use of too high a temperature may result in coarsening of crystal grains, and precipitated AlN grains, while too low a temperature may lead to the absence of recrystallization, or the insufficient growth of Goss grains, or insufficient precipitation of AlN even if recrystallization may take place. In order to obtain a reinforced inhibitor, it is also effective to employ an atmosphere gas having a nitrogen partial pressure of at least 30% in a temperature range of 800° C. to 1,000° C. during the heating step of secondary recrystallization annealing so that nitrogen may be positively diffused from the atmosphere gas into the steel to form AlN therein. The diffusion of N into the steel strip during the heating step of secondary recrystallization annealing calls for a high $N_2$ partial pressure in the atmosphere gas, and also depends on the nature of the oxide on the strip surface, or of the annealing separator employed. For example, if the $PH_2O/PH_2$ ratio in the atmosphere employed for the step of primary recrystallization annealing is varied to form scale rich in $SiO_2$, the diffusion of N is restricted, even if the $N_2$ partial pressure remains the same, while scale rich in FeO promotes the diffusion of N. The diffusion of N is retarded if MgO is employed as the annealing separator, and if, for example, $TiO_2$, $Na_2S_2O_3$, $Sb_2O_3$, boron or any compound thereof is added thereto. Thus, the nature of the atomosphere employed for the step of primary recrystallization annealing, and the type of the annealing separator employed must be taken into consideration in the selection of the optimum $N_2$ partial pressure in the atomosphere to be employed for the heating step of secondary recrystallization annealing.

It is also effective to employ a nitriding atmosphere for annealing the hot rolled strip, or its primary recrystallization annealing to form a nitride on the strip surface, and decompose it during the heating step of secondary recrystallization annealing to allow N to be diffused into the strip to form a reinforced AlN inhibitor.

For promoting the growth of crystal grains having a high density by secondary recrystallization, it is also very important to control the heating rate during the heating step of secondary recrystallization annealing, particularly after 800° C. It has been found possible to obtain a product having a drastically improved magnetic flux density if the strip is gradually heated at a rate not exceeding 20° C. per hour.

In the conventional manufacture of grain-oriented silicon steel employing AlN as an inhibitor, the slab to be heated usually contains 0.04 to 0.06% of carbon for the reason as hereinbefore set forth. This invention, however, employs a slab containing not more than 0.02%, preferably not more than 0.004%, of carbon to eliminate the necessity for decarburization after hot rolling. It is advisable to employ a melt of steel containing not more than 0.02%, preferably not more than 0.004%, of carbon. If steel contains more than 0.02% of carbon, it requires decarburization after hot rolling; otherwise, a number of problems might occur, including the $\gamma$ to $\alpha$ phase transformation hindering secondary recrystallization, poor magnetic properties due to a solid solution of carbon even if secondary recrystallization takes place, and magnetic aging resulting in the lowering of magnetic properties.

According to this invention, it is necessary to employ a slab containing 2.7 to 4% of silicon. If the slab contains a smaller quantity of silicon, the resulting product has a low specific resistance, and a great core loss. If it contains a larger quantity of silicon, a brittle strip results which is difficult to manufacture reliably on an industrial basis.

The slab contains 0.01 to 0.1% of aluminum. If it contains less aluminum, it fails to form a sufficiently large quantity of AlN for an inhibitor. If it contains more aluminum, coarse AlN grains are precipitated, and fail to be effective as an inhibitor.

The slab contains 0.002 to 0.02% of nitrogen, which reacts with aluminum to form AlN as an inhibitor. If it contains less nitrogen, sufficient AlN is not precipitated to provide a satisfactory inhibitor effect, while blisters or other defects are likely to occur if it contains more nitrogen.

Although this invention mainly employs AlN as an inhibitor, it is very effective to reinforce the inhibitor by adding Sb as hereinbefore described. The effect of Sb as an inhibitor is independent of the slab heating temperature. Antimony is effective if the slab contains 0.01% or more thereof, but if it contains more than 0.5% of antimony, it does not provide any increased effect, but makes the steel brittle.

Copper may be added to ensure the stability of secondary recrystallization. Copper is effective if 0.01% or more thereof is added, but if more than 1% of copper is added, it does not provide any increased effect, but makes the steel inferior in pickling resistance.

It is preferable that the crystal grains have an average diameter of 10 mm or less when hot rolling is started. The inventors have variously examined the behavior of recrystallization during the hot rolling of silicon steel having a very low carbon content. They have found that crystal grains having a larger diameter prior to hot rolling involve greater difficulty in recrystallization, irrespective of the hot rolling conditions. While it is known that crystal grains in the orientation of (100) [110] involve difficulty in recrystallization, it has also been found that in other orientations, too, crystal grains having a larger diameter involve greater difficulty in recrystallization. Recrystallization becomes particularly difficult if the crystal grains have an average diameter exceeding 10 mm prior to the commencement of hot rolling.

Recrystallization takes place during hot rolling at a temperature of about 900° C. to about 1,250° C. Only recovery, and hardly any recrystallizaton takes place at a temperature higher than 1,250° C., while only strain accumulation, and no recrystallization takes place at a temperature lower than 900° C. If rolling is conducted in the aforesaid temperature range, a higher reduction rate brings about a higher degree of recrystallization. If no higher reduction is possible by a single pass, a plurality of passes may be repeated each at a small reduction rate to achieve a high total reduction rate to promote recrystallization. For achieving the objective recrystallization of this invention, however, it is necessary to obtain a total reduction rate of at least 80% with a plurality of passes including at least one pass having a reduction rate of at least 35%.

According to this invention, it is, thus, important to start rough rolling at a temperature not exceeding 1,250° C., and obtain a total reduction rate of at least 80% with a plurality of passes, including at least one pass having a reduction rate of at least 35%, before the steel temperature drops to 900° C. Although recrystallization can take place in a temperature range of about 900° C. to about 1,250° C. as hereinbefore stated, it is likely to occur more easily in the vicinity of 1,100° C. than at a higher or lower temperature. It is, therefore, preferable to start rough rolling at a temperature of 1,050° C. to 1,150° C., and achieve a total reduction rate of at least 80% before the steel temperature drops to 1,000° C.

The strain accumulation hot rolling of the strip may be commenced at a temperature of 900° C. or below, and preferably not exceeding 800° C. At a temperature exceeding 900° C., recrystallization or recovery occurs, and no strain accumulation is possible. A lower temperature, particularly not exceeding 800° C., is more effective for strain accumulation. This hot rolling may be effected at a reduction rate of at least 40%, and preferably at least 80%. If a lower reduction rate is employed for rolling at such a low temperature, sufficient strain is not created and does not reach the central layer of the strip. This results in not only the failure of crystal grains to be finely divided in the center of the strip during the subsequent annealing thereof, but also even causes the coarsening of the grains. Even if each pass may provide a low reduction rate, it is acceptable if a total reduction rate of at least 40%, preferably at least 80%, can be obtained.

It is preferred that the hot rolling time between the commencement of hot rolling and the lowering of the steel temperature to 950° C. be as short as possible, and 10 minutes at the longest. The size of precipitated AlN grains increases with a rise in temperature and with an increase in time, as already pointed out. It is, therefore, necessary to shorten the time for which AlN is exposed to a high temperature, in order to avoid coarsening of the AlN grains precipitated or grown with a temperature drop during hot rolling. Satisfactorily fine AlN grains are precipitated at a temperature not exceeding 950° C., preferably not exceeding 900° C., but at a temperature in excess of 950° C., coarser AlN grains are precipitated, and fail to be an effective inhibitor for secondary recrystallization. Thus, if the rolling time exceeds 10 minutes, there develops difficulty in secondary recrystallization.

It is not always necessary to anneal the hot rolled strip if the fine division of crystal grains by recrystallization and the precipitation of fine AlN grains are satisfactorily achieved during the step of hot rolling. The hot rolled strip is annealed for (i) the formation of Goss grains, (ii) the fine division of crystal grains in the matrix in the central layer of the strip by recrystallization, and (iii) the precipitation and distribution of fine AlN grains, as hereinbefore set forth. A high temperature and a high heating rate are effective for the formation of Goss grains. A high heating rate and a short time of heating at a low temperature are effective for the fine division of crystal grains as far as recrystallizaion can take place. AlN has a peak temperature of 800° C. to 850° C. for precipitation. If a lower temperature prevails, AlN may be heated for a long time, while at a higher temperature, it is necessary to shorten the heating time to avoid coarsening of the AlN grains.

The hot rolled strip may be annealed at a temperature of 700° C. to 950° C. A lower temperature presents difficulty in the formation of Goss grains, and recrystallization, while a higher temperature causes coarsening of the crystal grains, and AlN grains. Annealing may be for a maximum of 10 minutes. Any longer time is uneconomical.

The step of primary recrystallization annealing in the process of this invention does not include any decarburization, as opposed to the conventional primary recrystallization of grain-oriented silicon steel employing AlN as an inhibitor. In other respects, they are both intended for (i) the formation of Goss grains having a high density by rapid heating and recrystallization, (ii) the fine division and arrangement of crystal grains in the matrix by primary crystallization, and (iii) the formation on the strip surface of an oxide which will react with MgO to form a glass film during the step of secondary recrystallization annealing. While according to the conventional process, the annealing temperature depends mainly on decarburization, it depends mainly on rapid heating for recrystallization in accordance with this invention. According to this invention, the step of primary recrystallization annealing may be effected at a temperature of 700° C. to 900° C. No primary recrystallization takes place at a lower temperature than 700° C., while the use of a higher temperature may result in the formation of coarse grains and the lack of stability for secondary recrystallization, and is uneconomical. Annealing may be for a maximum of 10 minutes. A longer time of annealing does not produce any special result, but is merely uneconomical. As no decarburization need be taken into account, it is possible to effect annealing in an atmosphere which merely suits (i) the formation on the strip surface of an oxide which will form a uniform and highly adherent glass film during the heating step of secondary recrystallization annealing, and (ii) the formation of an oxide through which nitrogen can be uniformly diffused from the atmosphere gas into the steel during the heating step of secondary recrystallization annealing. It is, thus, possible to employ an oxidizing atmosphere having a $PH_2O/PH_2$ ratio of $\geqq 0.5$, and not causing any decarburization during the first half of the step of primary recrystallization annealing so that FeO may be formed on the strip surface, and a reducing atmosphere having a $PH_2O/PH_2$ ratio of $\leqq 0.1$ so that the iron oxide may be reduced to form $SiO_2$ uniformly in the surface layer of the strip. The uniform layer of $SiO_2$ ensures stability in the absorption of nitrogen from the atmosphere gas during the step of secondary recrystallization annealing, and reacts with an annealing separator to form an excellent glass film. It is necessary to avoid formation of too much FeO on the strip surface during the step of primary recrystallization annealing, since it is likely to be reduced only partially to form an inferior glass film in some portions, or cause more nitrogen to be absorbed in those portions from the atmosphere gas than in any other portion during the step of secondary recrystallization annealing. It is also necessary to avoid any insufficient formation of $SiO_2$, since it may result in the formation of an insufficient glass film and the non-uniformity in the absorption of nitrogen from the atmosphere gas during the step of secondary recrystallization annealing, hence nonuniformity in the growth of crystal grains by secondary recrystallization. No decarburization need be taken into consideration, since this invention employs a slab prepared from a melt having a very low carbon content.

According to this invention, it is very effective to reinforce AlN with an atmosphere gas during the step of secondary recrystallization annealing, since it would otherwise not always be possible to distribute AlN finely in the steel, as opposed to the conventional production of grain-oriented silicon steel employing AlN as an inhibitor, as hereinbefore pointed out. More specifically, it is preferable to employ an atmosphere gas having a nitrogen partial pressure of at least 30%, since it ensures the stability of secondary recrystallization. The atmosphere gas may be introduced into the annealing furnace sometime when it has a temperature of 800° C. to 1,000° C. during the heating step of secondary recrystallization annealing. No nitrogen is diffused from the atmosphere gas to form AlN at a temperature below 800° C. Secondary recrystallization commences at a temperature of, say, 900° C. to 950° C., and is substantially completed at a temperature of 1,000° C. for the steel involved in the process of this invention. After the completion of secondary recrystallization, any further increase in the formation of AlN is harmful, since it increases impurities in the steel strip, and lowers its magnetic properties.

It is advisable to employ a heating rate not exceeding 20° C. per hour during the heating step of secondary recrystallization annealing. It is known that a low heating rate contributes to drastically improving the magnetic properties of conventional grain-oriented silicon steel employing AlN as an inhibitor. This has also been found to be the case with the grain-oriented silicon steel strip produced from a silicon steel slab having a very low carbon content in accordance with this invention. The improved magnetic properties are due to the growth of only Goss grains having a high density if a low heating rate is employed. As Goss grains start their predominant growth at a temperature of about 800° C. or above, it is satisfactory to employ a low heating rate at a temperature in a range above 800° C. As the Goss grains complete their predominant growth at a temperature of about 1,000° C. above which no new Goss grains grow, it is advantageous to employ a low heating rate in a temperature range not exceeding 1,000° C. It is, thus, preferable to employ a controlled heating rate at a temperature in the range of 800° C. to 1,000° C. Although greater results can be expected from a lower heating rate, it means a longer annealing time, and a disadvantage in the economy of thermal energy. It is, therefore, advisable to employ a heating rate of 20° C. per hour, or lower.

According to this invention, a silicon steel slab is heated to a greatly lower temperature than according to the conventional process for the manufacture of a silicon steel strip, as hereinbefore set forth. This means the lower effect of the inhibitor, and various methods are employed to reinforce the inhibitor as hereinabove described. For the reinforcement of the inhibitor, it is also effective to introduce a nitride-forming gas, such as $NH_3$, into the atmosphere gas employed during the annealing of the hot rolled strip, or the primary recrystallization annealing of the strip to form a mainly iron nitride layer in the surface layer of the strip, and decompose the iron nitride during the step of secondary recrystallization annealing so that nitrogen may be diffused into the strip and react with aluminum therein to form AlN. If $NH_3$ is, for example, employed, it is effective to introduce 10 to 1,000 ppm thereof. No effect can be expected if less than 10 ppm of $NH_3$ are introduced, while if more than 1,000 ppm are employed, silicon nitride is formed in the crystal boundary, and not only affects the stability of secondary crystallization, but also embrittles the steel strip.

The invention will now be described more specifically with reference to several examples thereof.

EXAMPLE 1

A continuously cast silicon steel slab having a thickness of 250 mm, and containing 0.004% C, 3.12% Si, 0.04% Al and 0.007% N, the balance being unavoidable impurities, was heated at 1,100° C. for two hours, and rough rolled immediately into a bar having a thickness of 20 mm. The steel had a temperature of 900° C. when it was rolled into a thickness of 20 mm. The bar was left at rest in front of a finish rolling mill until its temperature dropped to 850° C. Then, it was finish rolled into a hot rolled strip having a thickness of 2.3 mm. For comparison purposes, a similar slab was heated at 1,350° C. for two hours, rough rolled immediately, and finish rolled into a hot rolled strip having a thickness of 2.3 mm. The finish hot rolling of the strip was terminated at a temperature of 1,000° C. Some of the hot rolled strips were annealed at 850° C. for two minutes, while the other strips were not annealed. All of the strips were cold rolled into a thickness of 0.3 mm. The cold rolled strips were annealed for primary recrystallization at 850° C. for two minutes, and finish annealed. The finish annealing of some of the strips was performed in an atmosphere gas containing 50% $N_2$ during the heating step up to 1,000° C., while the other strips were finish annealed in an atmosphere gas containing 25% $N_2$. The properties of the products thus obtained are shown in TABLE 1 below. As is obvious from TABLE 1, the products of this invention obtained by employing a lower temperature for slab heating and finish annealing showed excellent secondary recrystallization, and magnetic properties.

TABLE 1

| | Processing conditions | | | Properties of products | | |
|---|---|---|---|---|---|---|
| Sample* | Slab Temp. | Annealing of hot rolled strip | $N_2$ in finish annealing atmosphere | Secondary recrystallization (%) | $B_8$ (Wb/m$^2$) | $W_{10/50}$ (W/kg) |
| x | 1,350° C. | Yes | 50% | 0 | — | — |
| x | " | No | " | 0 | — | — |
| x | " | Yes | 25% | 0 | — | — |
| x | " | No | " | 0 | — | — |
| o | 1,100° C. | Yes | 50% | 100 | 1.87 | 1.32 |
| o | " | No | " | 100 | 1.75 | 1.44 |
| o | " | Yes | 25% | 100 | 1.83 | 1.40 |
| o | " | No | " | 100 | 1.70 | 1.52 |

Sample:
o: Invention;
x: Comparative.

EXAMPLE 2

A continuously cast slab of silicon steel containing 0.002% C., 3.30% Si, 0.05% Al and 0.01% N, the balance being unavoidable impurities, and broken down to have a crystal grain diameter not exceeding 10 mm was heated at 1,150° C. for two hours, and rough rolled immediately into a bar having a thickness of 25 mm by four passes. The bar had a temperature of 1,075° C. The bar was, then, finish hot rolled, and when it was rolled into a strip having a thickness of 5 mm, it had a temperature of 900° C. The strip was further rolled, while it was being forcibly cooled between the roll stands, and when it was rolled into a thickness of 2.3 mm, it had a temperature of 750° C. For comparison purposes, a slab was extracted at 1,100° C. and hot rolled immediately, and when it was rolled into a strip having a thickness of 2.3 mm, it had a temperature of 900° C.

The hot rolled strips thus obtained were annealed at 1,100° C. for five minutes or at 850° C. for five minutes, annealed for primary recrystallization at 800° C., and finish annealed at 1,200° C. for 20 hours. A heating rate of 30° C. per hour was employed for finish annealing except for one sample for which a heating rate of 10° C. per hour was employed. The results are shown in TABLE 2 below. As is obvious from TABLE 2, the products of this invention obtained by employing a lower temperature for hot rolled strip annealing and finish annealing showed excellent magnetic properties, particularly when a lower heating rate of 10° C. per hour was employed. One of the samples of this invention for which the higher temperature had been employed for hot rolled strip annealing was somewhat inferior in magnetic properties.

TABLE 2

| | Processing conditions | | | Properties of products | | |
|---|---|---|---|---|---|---|
| Sample* | Finish hot roll ending temp. | Hot rolled strip anneal temp. | Heating rate for finish annealing | Secondary recrystallization (%) | $B_8$ (Wb/m$^2$) | $W_{17/50}$ (W/kg) |
| o | 750° C. | 1,000° C. | 30° C./h | 100 | 1.86 | 1.30 |
| o | " | 850° C. | 30° C./h | 100 | 1.90 | 1.20 |
| o | " | 850° C. | 10° C./h | 100 | 1.94 | 1.10 |
| x | 900° C. | 1,000° C. | 30° C./h | 30 | — | — |

TABLE 2-continued

| Sample* | Processing conditions: Finish hot roll ending temp. | Hot rolled strip anneal temp. | Heating rate for finish annealing | Properties of products: Secondary recrystallization (%) | $B_8$ (Wb/m$^2$) | $W_{17/50}$ (W/kg) |
|---|---|---|---|---|---|---|
| x | " | 850° C. | 30° C./h | 60 | — | — |

Sample:
o: Invention;
x: Comparative.

EXAMPLE 3

A silicon steel slab containing 0.002% C, 3.70% Si, 0.04% Al, 0.20% Cu and 0.008% N, the balance being unavoidable impurities, and having a thickness of 250 mm was hot rolled at a temperature of 1,150° C. in such a manner that a strip having a thickness of 5 mm might have a temperature of 750° C., and that a strip having a thickness of 2.3 mm might have a temperature of 700° C. The strip was annealed at a temperature up to 900° C., and immediately thereafter held at 850° C. for two minutes, followed by water cooling. The strip was, then, cold rolled into a thickness of 0.3 mm, and annealed for primary and secondary recrystallization. The hot rolling of a comparative sample was started when it had a temperature of 1,350° C., and terminated when a hot rolled product having a thickness of 2.3 mm at a temperature of 1,000° C. was obtained. Otherwise, the procedures of the invention were repeated. The product of this invention did not crack or break during any part of the process, but the comparative sample was very brittle, and cracked or broke during the steps of pickling and cold rolling. The results are shown in TABLE 3 below. The product of this invention showed not only excellent magnetic properties, but also a very high degree of workability without cracking or breaking throughout the process after hot rolling.

TABLE 3

| Sample | Hot rolling conditions: Starting temp. | Ending temp. | Cracking after hot rolling | Properties of products: Secondary recrystallization (%) | $B_8$ (Wb/m$^2$) | $W_{17/50}$ (W/kg) |
|---|---|---|---|---|---|---|
| Invention | 1,150° C. | 700° C. | No | 100 | 1.90 | 1.10 |
| Comparative | 1,350° C. | 1,000° C. | Yes | 0 | — | — |

EXAMPLE 4

A silicon steel slab containing 0.002% C, 3.45% Si, 0.03% Al, 0.1% Sb and 0.010% N, the balance being unavoidable impurities, and having a thickness of 200 mm and a controlled average crystal grain diameter not exceeding 7 mm was heated to 1,200° C. for two hours, and hot rolled immediately. When it was rolled into a thickness of 30 mm in one minute, it had a temperature of 950° C. The steel was left at rest in front of a rolling mill until its temperature dropped to 900° C. Then, it was rolled while it was being forcibly cooled between the roll stands, and when it was rolled into a strip having a thickness of 2.3 mm, it had a temperature of 750° C. For comparison purposes, a similar slab was heated at 1,350° C. for two hours, and hot rolled immediately. When the steel was rolled into a thickness of 2.3 mm, it had a temperature of 1,000° C. The strips were, then, cold rolled into a thickness of 0.3 mm, and finish annealed. The results are shown in TABLE 4 below. As is obvious from TABLE 4, the product of this invention showed excellent secondary recrystallization, and magnetic properties.

TABLE 4

| Sample | Hot rolling conditions: Slab temp. (°C.) | Hot rolling ending temp. (°C.) | Properties: Secondary recrystallization (%) | $B_8$ (Wb/m$^2$) | $W_{17/50}$ (W/kg) |
|---|---|---|---|---|---|
| Invention | 1,200 | 700 | 100 | 1.90 | 1.09 |
| Comparative | 1,350 | 1,000 | 0 | — | — |

EXAMPLE 5

A silicon steel slab containing 0.002% C, 3.70% Si, 0.04% Al, 0.07% Cu, 0.05% Sb and 0.008% N, the balance being iron and unavoidable impurities, and having a thickness of 300 mm was rolled at a reduction rate of 40% at a temperature of 1,100° C., and after it had been heated at 1,100° C. for an hour, it was immediately hot rolled. It was rolled into a thickness of 15 mm, and wound into a coil. The coil had a temperature of 900° C. The coil was, then, finish hot rolled into a hot rolled strip having a thickness of 2.3 mm, while it was being forcibly cooled. The strip as hot rolled had a temperature of 650° C. The strip was, then, cold rolled without being annealed, and the cold rolled strip was annealed for primary and secondary recrystallization, and examined for magnetic properties and secondary recrystallization. For comparison purposes, a similar slab was heated at 1,350° C. for an hour, and hot rolled immediately. When it was rolled into a hot rolled strip having a thickness of 2.3 mm, it had a temperature of 950° C. Otherwise, the procedures of this invention were repeated. The comparative sample was very brittle, and cracked or broke substantially during pickling and cold rolling. The results are shown in TABLE 5 below. As is obvious from TABLE 5, the product of this invention showed 100% secondary recrystallization, and excellent magnetic properties.

TABLE 5

| Sample | Hot rolling conditions: Slab temp. (°C.) | Hot rolling ending temp. (°C.) | Properties: Secondary recrystallization (%) | $B_8$ (Wb/m$^2$) | $W_{17/50}$ (W/kg) |
|---|---|---|---|---|---|
| Invention | 1,100 | 650 | 100 | 1.88 | 1.10 |
| Comparative | 1,350 | 950 | *10 0 | — | — |

What is claimed is:

1. A process for producing an aluminum-bearing grain-oriented silicon steel strip from a silicon steel slab containing up to 0.2% carbon, 0.01 to 0.1% aluminum, 2.7 to 4.0% silicon, and 0.002 to 0.02% nitrogen, the balance being iron and unavoidable impurities, said slab optionally containing at least one of 0.01 to 0.5% antimony and 0.01 to 1.0% copper, said process comprising:

recrystallization hot rolling said slab, said rolling being commenced when said slab has a temperature up to 1,250° C., and effected at a total reduction rate of at least 80% with a plurality of passes, including at least one pass having a reduction rate of at least 35%, said rolling being completed by the time said steel has a temperature of 900° C.;

strain accumulation finish hot rolling said steel at a total reduction rate of at least 40% and at a steel temperature up to 900° C.;

annealing said hot rolled steel continuously at a temperature of 700° C. to 950° C.;

cold rolling said steel;

annealing said cold rolled steel continuously at a temperature of 700° C. to 900° C. for primary recrystallization; and finish annealing said steel in a furnace, an atmosphere gas containing at least 30% of nitrogen being introduced into said furnace sometime when said furnace has a temperature of 800° C. to 1,000° C. during said finish annealing.

2. A process as set forth in claim 1, wherein said recrystallization hot rolling is commenced when said slab has a temperature of 1,050° C. to 1,150° C., and is effected at a total reduction rate of at least 80% until before said steel has a temperature below 1,000° C., and wherein said strain accumulation finish hot rolling is effected at a total reduction rate of at least 80% at a steel temperature up to 800° C.

3. A process as set forth in claim 1, wherein said slab has an average crystal grain diameter up to 10 mm prior to said recrystallization hot rolling.

4. A process as set forth in claim 1, wherein said recrystallization hot rolling is conducted for up to 10 minutes before said steel has a temperature of 950° C.

5. A process as set forth in claim 1, wherein said strain accumulation finish hot rolling includes cooling said steel forcibly with water.

6. A process as set forth in claim 1, wherein said annealing of said hot rolled steel is conducted for up to 10 minutes.

7. A process as set forth in claim 1, wherein said annealing for primary recrystallization is conducted for up to 10 minutes.

8. A process as set forth in claim 1, wherein said finish annealing employs a heating rate up to 20° C. per hour in a temperature range between 800° C. and a higher temperature at which secondary recrystallization is terminated.

* * * * *